US010857566B2

(12) United States Patent
Chapman

(10) Patent No.: US 10,857,566 B2
(45) Date of Patent: Dec. 8, 2020

(54) EFFICIENT INFRARED ABSORPTION SYSTEM FOR EDGE SEALING MEDIUM DENSITY FIBERBOARD (MDF) AND OTHER ENGINEERED WOOD LAMINATES USING POWDER AND LIQUID COATINGS

(71) Applicant: Heraeus Noblelight GmbH, Hanau (DE)

(72) Inventor: Michael J Chapman, Portsmouth, RI (US)

(73) Assignee: Heraeus Noblelight GmbH, Hanau (DE)

( * ) Notice: Subject to any disclaimer, the term of this patent is extended or adjusted under 35 U.S.C. 154(b) by 1 day.

(21) Appl. No.: 15/978,144

(22) Filed: May 13, 2018

(65) Prior Publication Data

US 2018/0257106 A1 Sep. 13, 2018

Related U.S. Application Data

(60) Continuation-in-part of application No. 15/382,686, filed on Dec. 18, 2016, now abandoned, which is a division of application No. 14/855,234, filed on Sep. 15, 2015, now abandoned.

(51) Int. Cl.

| | |
|---|---|
| ***B05D 1/04*** | (2006.01) |
| ***B05D 1/06*** | (2006.01) |
| ***B05D 3/02*** | (2006.01) |
| ***B05D 7/08*** | (2006.01) |
| ***B05D 7/00*** | (2006.01) |
| ***B05D 7/06*** | (2006.01) |

(52) U.S. Cl.

CPC ..... *B05D 3/0263* (2013.01); *B05D 1/045* (2013.01); *B05D 3/0218* (2013.01); *B05D 7/06* (2013.01); *B05D 7/08* (2013.01); *B05D 7/546* (2013.01); *B05D 1/06* (2013.01); *B05D 2401/32* (2013.01); *B05D 2420/01* (2013.01)

(58) Field of Classification Search

CPC ..... B05D 2401/32; B05D 1/045; B05D 2420/01; B05D 3/0263; B05D 7/08; B05D 7/06; B05D 7/546; B05D 3/0218; B27K 2200/15; B27K 5/001; F26B 15/14; F26B 3/30; B05B 5/025

See application file for complete search history.

(56) References Cited

U.S. PATENT DOCUMENTS 6,088,931 A * 7/2000 Aylor ..... F26B 3/283 34/267
6,204,083 B1 * 3/2001 Kodato ..... G01J 3/108 438/43
6,932,593 B2 8/2005 Chapman (Continued)

OTHER PUBLICATIONS

Chapman, Michael. "MDF powder coating: A practical update". Powder Coating Magazine, Nov. 2010. (Year: 2010).*

(Continued)

*Primary Examiner* — Alexander M Weddle
(74) *Attorney, Agent, or Firm* — Stradley Ronon Stevens & Young, LLP

(57) ABSTRACT

A method for coating and curing a material on a product having a plurality of edges and faces. More specifically, disclosed is an efficient method for coating and curing engineered wood products (EWP) in general, and the edges of EWP in particular.

16 Claims, 9 Drawing Sheets

(56) References Cited

U.S. PATENT DOCUMENTS

| | | | | |
|---|---|---|---|---|
| 7,159,535 | B2 | 1/2007 | Chapman | |
| 2004/0234919 | A1* | 11/2004 | Chapman | B05D 3/0254 432/175 |
| 2006/0115244 | A1* | 6/2006 | Linow | H05B 3/145 392/407 |
| 2012/0294595 | A1 | 11/2012 | Veltrop et al. | |

OTHER PUBLICATIONS

Michael Chapman, "MDF powder coating: A practical update" Powder Coating Magazine Nov. 2010.

* cited by examiner

EFFICIENT INFRARED ABSORPTION SYSTEM FOR EDGE SEALING MEDIUM DENSITY FIBERBOARD (MDF) AND OTHER ENGINEERED WOOD LAMINATES USING POWDER AND LIQUID COATINGS

CROSS-REFERENCE TO RELATED APPLICATIONS

The present application is related to, claims the earliest available effective filing date(s) from (e.g., claims earliest available priority dates for other than provisional patent applications; claims benefits under 35 U.S.C. § 119(e) for provisional patent applications), and incorporates by reference in its entirety all subject matter of the following listed application(s) (the "Related Applications") to the extent such subject matter is not inconsistent herewith; the present application also claims the earliest available effective filing date(s) from, and also incorporates by reference in its entirety all subject matter of any and all parent, grandparent, great-grandparent, etc. applications of the Related Applications to the extent such subject matter is not inconsistent herewith:

This application is a continuation-in-part patent application of pending application Ser. No. 15/382,686, filed on Dec. 18, 2016 entitled "Efficient Infrared Absorption Systems and Methods for Edge Sealing Medium Density Fiberboard (MDF) and Other Engineered Wood Laminates Using Powder and Liquid Coatings" naming Michael J. Chapman as inventor, which is a divisional patent application of now abandoned application Ser. No. 14/855,234, filed on Sep. 15, 2015 entitled "Efficient Infrared Absorption Systems and Methods for Edge Sealing Medium Density Fiberboard (MDF) and Other Engineered Wood Laminates Using Powder and Liquid Coatings" naming Michael J. Chapman as inventor.

BACKGROUND

1. Field of Use

This invention relates to an improved apparatus for infrared heating and curing powder coatings on porous wood products, such as medium density fiberboard (MDF). More specifically, the invention relates to a novel arrangement of infrared beaters for efficiently heating and curing powdered coatings on MDF.

2. Description of Prior Art (Background)

For the past twenty-five years powder coating of metal parts has become a popular method of finishing. There are numerous suppliers of the powder coating catering to all segments of the metal industry, ranging from automotive to architectural to marine applications. Powder on metal has become a mature industry. The principle method of applying powder to metal parts charges the powder particles via a powder spray gun. The charged particles are then attracted to metal parts that are earthed via a grounded hanging device on a conveying system.

Wood, or engineered wood products (EWP), such as medium density fiberboard (MDF) are not naturally as conductive as typical metal parts. MDF is made to become conductive by preheating the MDF to a range that is between about 150 and 250 degrees Fahrenheit. Preheating the MDF activates the moisture content of the MDF (typically about 5-10%) causing it to become conductive. Thus, charged powder will attach to a properly grounded MDF.

Once the powder is attached to the board, the method of curing has been by either heating the powder in a convection oven for a certain period of time or by infrared heating for a period of time that is less than that of a convection oven. The infrared heat source has been either electric resistance heaters or catalytic heaters. In recent years, catalytic heaters have attracted considerable attention as the preferred choice of infrared heat sources.

Curing powder coatings on MDF using an infrared heat source has given rise to certain difficult problems. MDF is available in various thicknesses ranging from one-quarter (¼) inch through to two inches, for example. With all thicknesses, the face surfaces of the MDF are of a considerably higher density than the core of the board. The greater the thickness of the MDF, the greater the difference is between the core density and the face surface density. MDF has a certain amount of naturally occurring porosity within the board structure and hence a characteristic moisture content. The greater the thickness, the greater the porosity due to the lower core density.

When heating powder-coated MDF to cause the powder or liquid to cure, the board is typically hanging in a vertical position. As the board heats, the entrapped moisture expands and out-gases through the edges of the board, typically from the center of the core in the area of lowest density. During the curing process using a conventional catalytic heating oven, the face surfaces of the board are easily heated, while the edges, especially the vertical edges, do not receive a full direct line of site of infrared energy. As a result, the edges of the board are the last to cure as compared to the face surfaces. This leads to an occurrence where the expanding moisture, which is out-gassing from inside the board, bubbles and forms blisters along the side edges of the board. These blisters occur because the powder at the edges has not reached a degree of cure, as compared to the face of the board, which would prevent the blisters from forming.

Furthermore, powder coatings going through the curing process first turn to liquid and then a gel stage followed by a curing stage where the powder reaches its full cured properties. However, the liquefied powder will be drawn into the edges of the MDF in a similar manner to a wood edge grain absorbing liquids. The result is an undesirably different look and feel to that of the coated and cured face sides of the MDF and EWP. In general, the edges will display pitting and/or protruding fibers.

Depending on the method of cutting and sanding the edges of the MDF, the fibers will protrude in varying degrees. The degree of this protrusion is dependent on the density across the board thickness and a number of other factors having to do with the physical properties of the board: fiber type and length, percentage and type of glue used, and the MDF and/or the EWP manufacturing process in general.

Thus, the manufacturing and pre-finishing processes for the MDF, along with the precise application of the powder thickness on the edges, contribute too many variables that may produce sub-standard edge finishes, resulting in waste and low yields.

To compensate for the issues associated with powder coating the edges of MDF, the present state of the art employs a two-coat process. First, a powder prime coat is applied to the edges and faces of the MDF, partially cured, followed by a powder top coat and then the two coats are co-cured together. The end result provides an acceptable edge finish that mitigates, but does not eliminate, the undesirable variables mentioned above.

It will be appreciated that while it is only the edges of the MDF that require the prime coat, the entire board is primed as part of the overall process, resulting in unnecessary expenses since the primer coat adds no extra cosmetic benefit to the face sides of the MDF. Additionally, there is the extra capital equipment cost of the primer powder application station and associated primer curing oven.

Thus, there exists a need for a system and method for the edge treatment of MDF and EWP to maintain a high quality powder or liquid coated MDF or EWP while reducing associated manufacturing expenses.

BRIEF SUMMARY

The foregoing and other problems are overcome, and other advantages are realized, in accordance with the presently preferred embodiments of discussed below.

The invention is directed towards an efficient production line for curing an epoxy powder or liquid primer. The production line includes an edge sealing oven vestibule or booth having at least one focused infrared (IR) emitter assembly. The focused IR emitter assembly is adaptable or configured to emit an IR energy field or pattern substantially matched to a predetermined absorption characteristic of the epoxy powder or liquid primer. The focused IR emitter assembly is adaptable or configured to emit the focused IR energy field comprising substantially a 60 degree arc.

A focused infrared apparatus for curing a primer coated edge is provided. The apparatus includes at least one focused infrared (IR) emitter assembly adaptable or configured to emit IR energy substantially matched to a predetermined absorption characteristic of the primer and is adaptable or configured to emit a focused IR energy pattern substantially focused on the primer coated edge.

The invention is also directed towards an apparatus for edge-curing engineered wood products (EWP) with trailing and leading edges and supported by a conveyor track. The apparatus includes a first infrared (IR) emitter assembly having a first plurality of infrared emitters for emitting IR energy; and a first reflector adaptable or configured to reflect the IR energy emitted by the first plurality of IR emitters. The apparatus also includes a second infrared emitter assembly having a second plurality of infrared emitters for emitting IR energy; and a second reflector adaptable or configured to reflect the IR energy emitted by the second plurality of IR emitters. The first IR emitter assembly and the second IR emitter assembly are disposed on opposite sides of the conveyor track and offset from a common axis by a predetermined amount, and are adaptable or configured to overlap respective IR energy fields onto the trailing edge of the EWP.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

The following brief definition of terms shall apply throughout the application:

The term "outer" or "outside" refers to a direction away from a user, while the term "inner" or "inside" refers to a direction towards a user;

The term "comprising" means including but not limited to, and should be interpreted in the manner it is typically used in the patent context;

The phrases "in one embodiment." "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example; and If the specification states a component or feature "may," "can," "could," "should," "preferably," "possibly," "typically," "optionally," "for example," or "might" (or other such language) be included or have a characteristic, that particular component or feature is not required to be included or to have the characteristic.

The term "cure," "cured," or "curing" shall be understood to mean the hardening of a suitable edge covering material. Further, curing may be brought about by chemical additives, ultraviolet radiation (UV), or applied heat.

Figure 1:
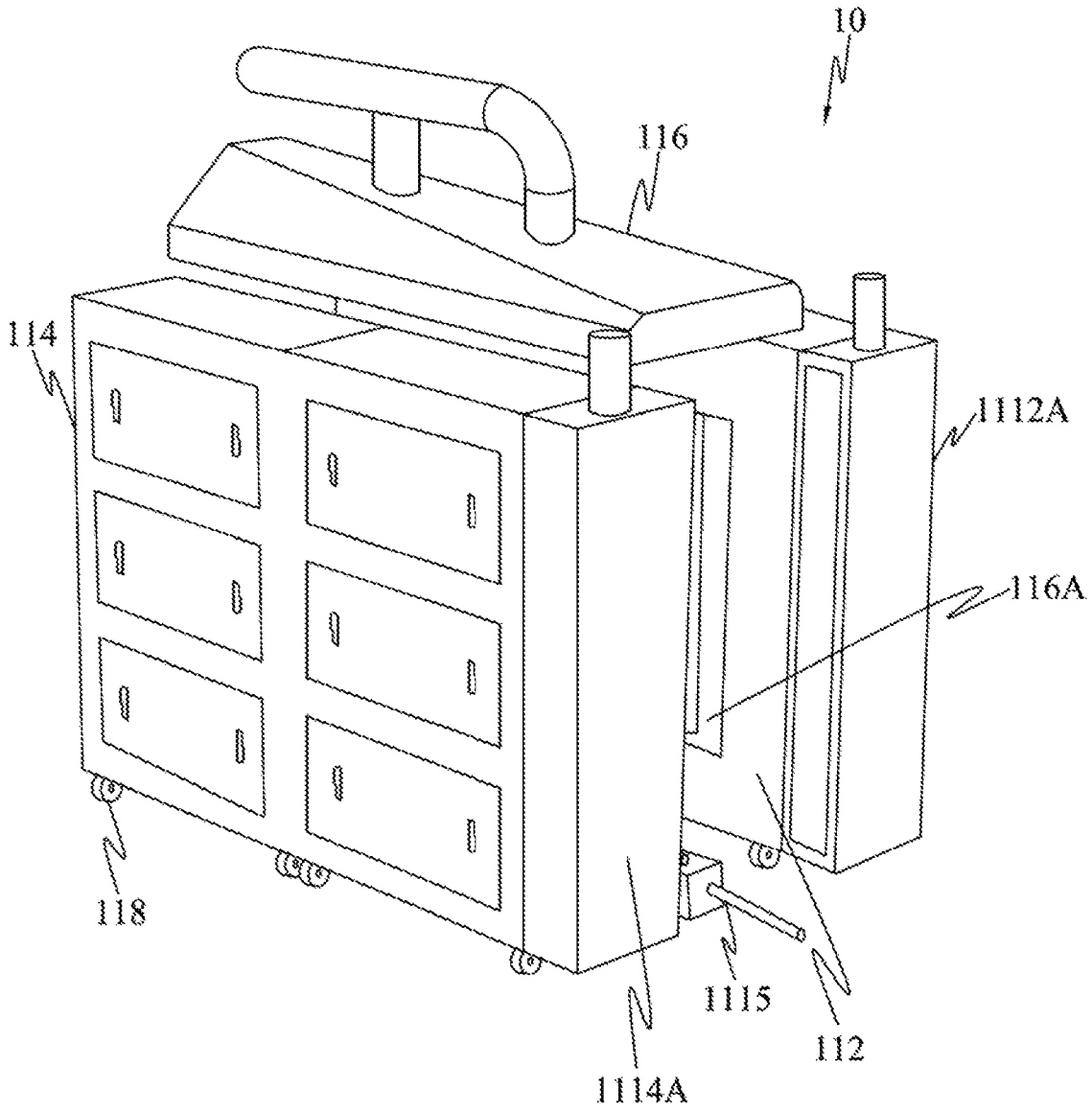
FIG. 1 is a pictorial view of an edge sealing oven incorporating features of the present invention.

Referring now to FIG. 1, there is shown a pictorial view of an edge sealing oven 10 incorporating features of the present invention. Included are a vestibule hood 116, a left vestibule 114, a left air knife 1114A, a right vestibule 112, a right air knife 1112A, a convection oven 1115, and wheels 118.

The air knife 1114A and the air knife 1112A provide gas flows, respectively. The gas flows may be any suitable gas flow, such as, for example, high pressure air.

Figure 2:
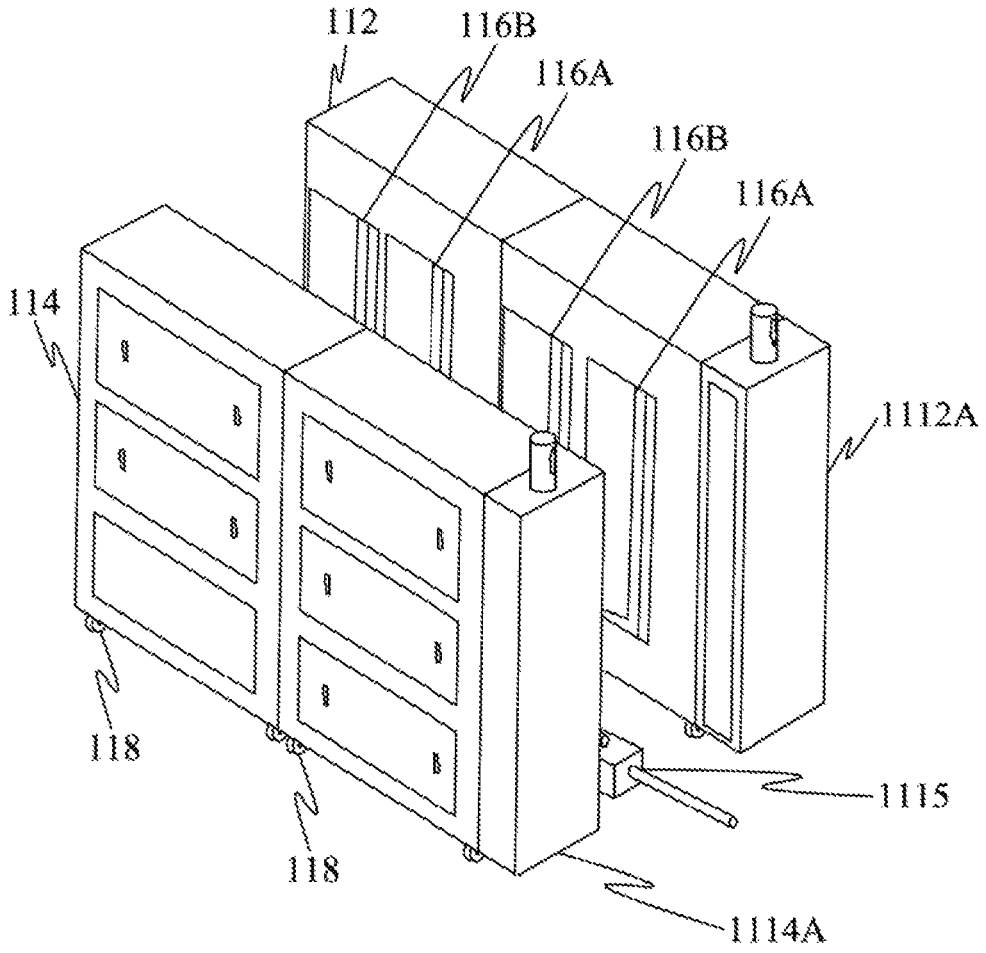
FIG. 2 is a pictorial view of the edge sealing oven shown in FIG. 1 showing placement of one bank of infrared sources.

Referring also to FIG. 2, there is shown a pictorial view of the edge sealing oven 10 shown in FIG. 1 showing placement of banks of infrared sources 116A, 116B.

Figure 3:
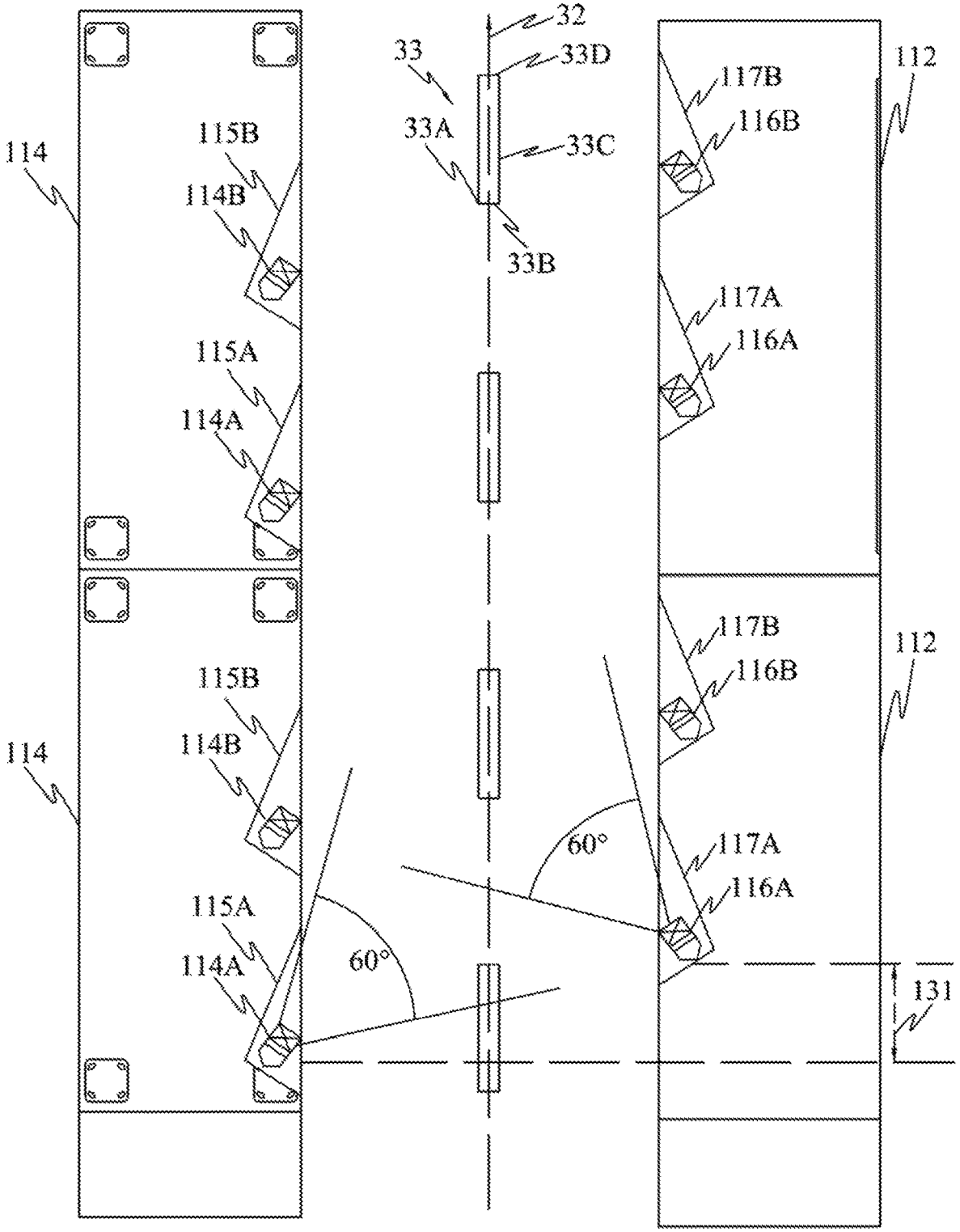
FIG. 3 is top down view of the edge sealing oven shown in FIG. 1 showing relative placement and radiation angles of the infrared sources.

Referring also to FIG. 3, there is shown a top down view of the edge sealing oven 10 shown in FIG. 1 showing relative placement and radiation angles of the infrared sources. The infrared sources 114A, 114B, 116A, and 116B are situated in housings 115A, 115B, 117A and 117B, respectively. It will be appreciated that the infrared sources are rotatable within their respective housings, thus each housing is adapted or configured to allow the outward and unobstructed expression of the full radiation pattern emitted by the infrared source contained within that housing.

As shown in FIG. 3, the infrared sources, e.g., 114A and 116A, are located on opposite sides of a product 33 and set at a predetermined angle to radiate infrared energy onto a trailing edge 33B of the product 33 and wherein the radiated infrared energy is a focused infrared energy pattern or field comprising substantially a 60 degree arc. It will be understood that any suitable focused infrared energy pattern may be used. Also as shown in FIG. 3, the infrared sources, e.g., 114A and 116A, are staggered, or offset from a common axis, on either side of travel of the product 33 by a predetermined offset amount 131. It will be appreciated that offsetting the infrared sources by the predetermined offset amount 131 controls the amount of combined or overlapped infrared energy imposed on the trailing edge 33B.

The product 33 shown in FIG. 3 is an example of a coated product such as a coated MDF or coated EWP. The coated product 33 may include faces 33A and 33C. In general, the coated product 33 will include the trailing edge 33B and a leading edge 33D. It will be understood that the trailing and leading edges are defined according to the direction of travel through the edge sealing oven 10 as depicted by the direction arrow 32.

Figure 4:
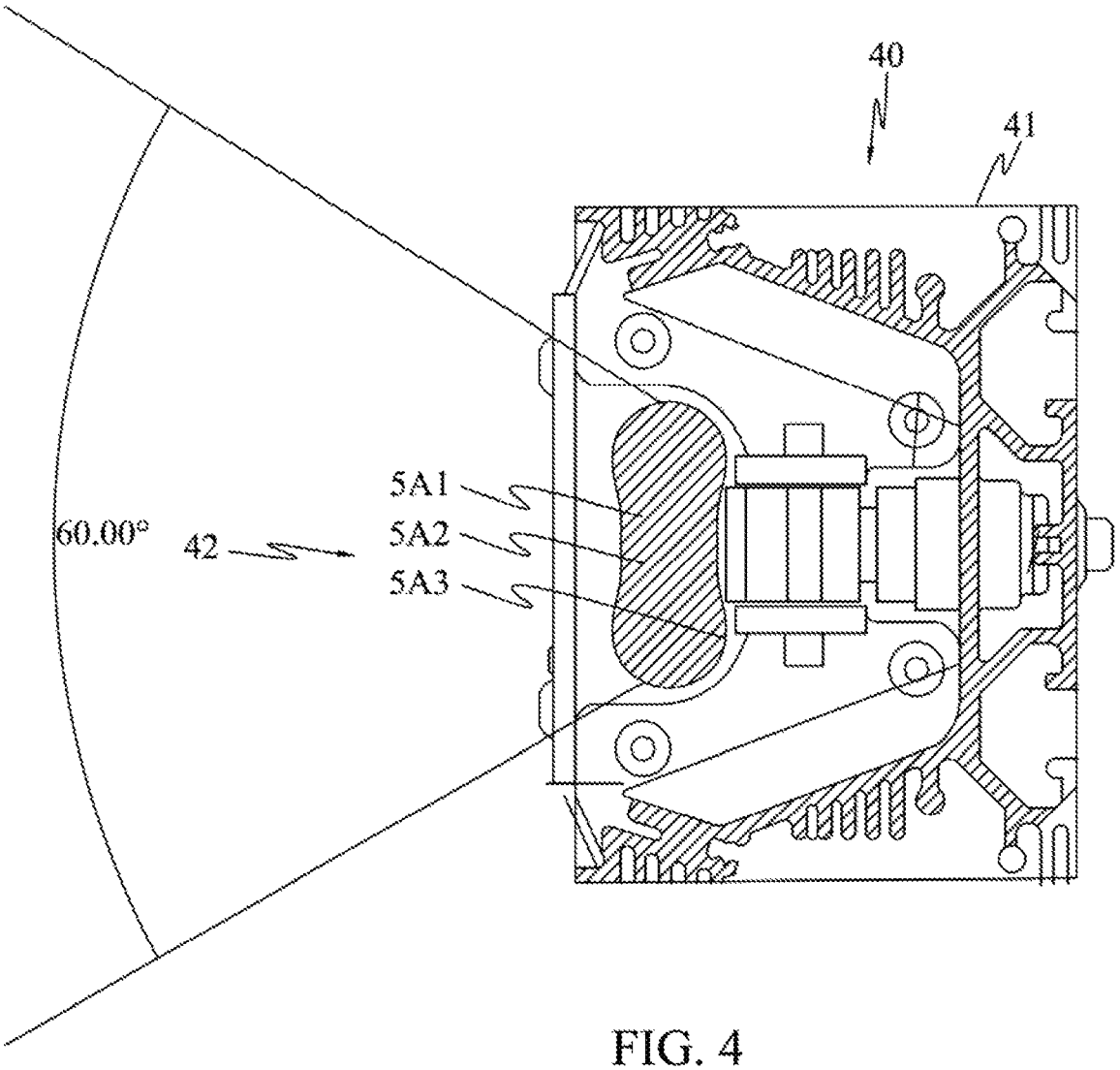
FIG. 4 is top down view of an infrared source shown in FIG. 2 or FIG. 3.

Referring to FIG. 4, there is shown a top down view of an example infrared source 40 that might be used as one or more of the infrared sources 114A, 114B, 116A, and 116B shown in FIG. 2 or FIG. 3. The infrared source 40 may be any suitable focused infrared source, such as, for example, a short wave, medium wave, or long wave infrared emitter. It will also be appreciated that edge sealing ovens incorporating features of the present invention may utilize multiple groups or pluralities of infrared sources that optimally perform a desired function. For example, a first plurality of focused infrared sources may have a short-wave emission wavelength that preferentially interacts with a predetermined absorption characteristic of a coated surface or edge of an MDF, while a second plurality of infrared sources may have a medium wave emission wavelength that preferentially interacts with a second predetermined absorption characteristic of a coated edge or face of the MDF. Accordingly, operations on an MDF may be efficiently performed without expending energy emitting large amounts of radiation at unnecessary wave lengths.

Still referring to FIG. 4, the infrared source 40 includes a fixture 41 and an infrared assembly 42.

The fixture 41 may be any suitable fixture for holding the infrared assembly 42 and adaptable or configured to rotate within a respective housing (see FIG. 3).

The focused infrared assembly 42 includes an infrared emitter 5A1, a transmission medium 5A2, and a reflector 5A3. The infrared assembly 42 is adapted or configured to emit a focused infrared energy pattern comprising a 60 degree arc.

The infrared emitter 5A1 may be any suitable IR emitter for heating MDF (such as the product 33). For example, the infrared emitter 5A1 may be any suitable short wave, medium wave, or long wave IR emitter. For example, the IR emitter 5A1 may be a resistive element, a chromium alloy filament, or a tungsten filament. In alternate embodiments, the IR emitter 5A1 may include a single heating filament or a pair of heating filaments.

Still referring to FIG. 4, the transmission medium 5A2 may be any suitable medium which substantially allows the IR energy emitted by the IR emitter 5A1 to transition from its source to the MDF to be heated. For example, the transmission medium 5A2 may be any suitable transparent or semi-transparent quartz glass. It will also be appreciated that the transmission medium 5A2 may be suitably shaped or formed to direct or focus the IR energy. For example, the transmission medium 5A2 may contain characteristics of a focusing lens, such as, for example, a Fresnel lens.

Still referring to FIG. 4, the reflector 5A3 may be any suitable reflector for reflecting IR energy generated by the IR emitter 5A1 through the transmission medium 5A2. For example, the reflector 5A3 may comprise a gold coated reflector and/or an aluminum reflector. It will be appreciated that a gold coated reflector can almost double the effective radiation arriving at the trailing edge 33B of the product 33.

Still referring to FIG. 4, the reflector 5A3 may be an opaque quartz glass located directly on the emitter 5A1 and therefore need not be brought into the correct position first as is the case with external reflectors.

It will also be appreciated that the transmission medium 5A2 and/or the reflector 5A3 may be suitably shaped or formed to direct, focus, or concentrate the IR energy onto a particular area of the product 33. For example, the, transmission medium 5A2 may contain characteristics of a Fresnel lens.

Figure 5A:
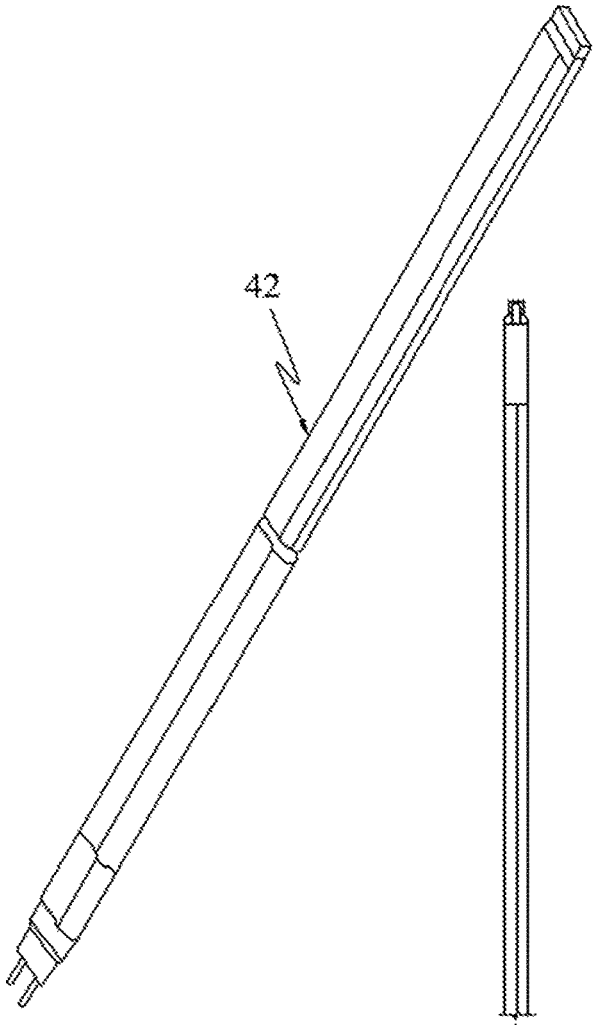
FIG. 5A is a perspective view of an infrared source shown in FIG. 2 or FIG. 3.

Referring to FIG. 5A, there is shown a perspective view of the infrared assembly 42 shown in FIG. 4. The infrared assembly 42 may be any suitable focused infrared assembly such as, for example, a tubular assembly.

Figure 5B:
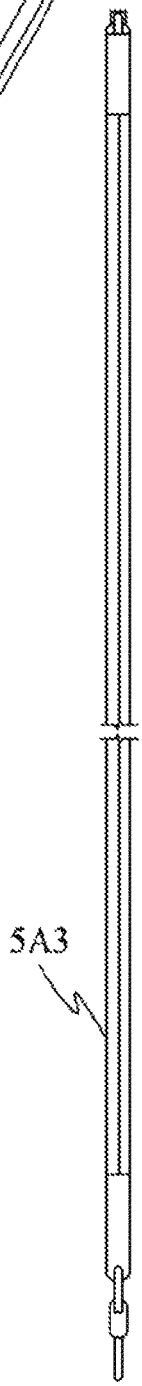
FIG. 5B is a side view of an infrared source shown in FIG. 2 or FIG. 3.

Referring to FIG. 5B, there is shown a side view of the infrared assembly 42 shown in FIG. 4 highlighting the reflector 5A3. The reflector 5A3 may be any suitable reflector material such as, for example, gold, ceramic, or any suitable manmade or natural material.

Figure 5C:
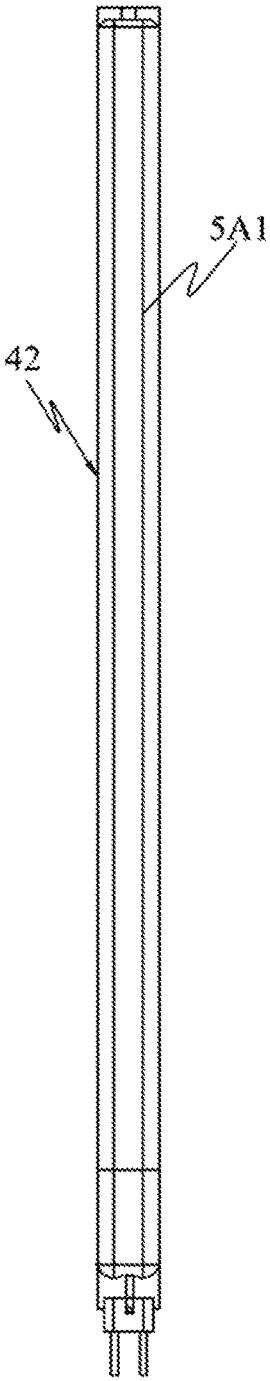
FIG. 5C is a front view of an infrared source shown in FIG. 2 or FIG. 3.

Referring to FIG. 5C, there is shown a front view of the infrared assembly 42 shown in FIG. 4 highlighting the IR emitter 5A1. It will be appreciated that the infrared assembly 42 may include any suitable number of IR emitters 5A1.

Figure 6:
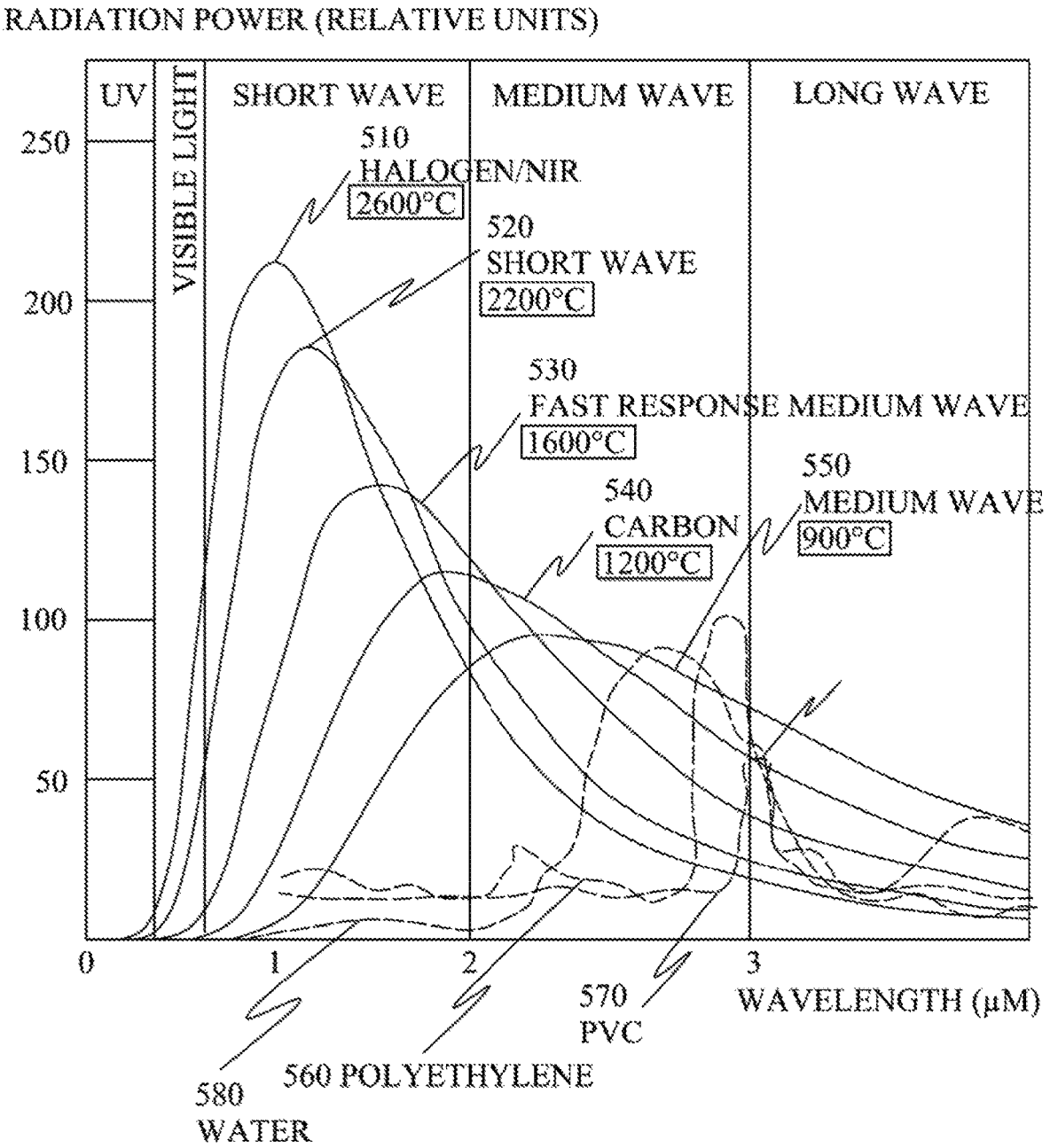
FIG. 6 illustrates examples of infrared emission spectra of some infrared sources that may be used in accordance with the edge sealing oven shown in FIG. 1.

Referring to FIG. 6, there is shown an illustration of examples of infrared emission spectra of some infrared sources that may be used in accordance with the edge sealing oven 10 shown in FIG. 1. Absorption patterns of various powders or liquids that may be exposed to radiation from infrared sources within a hybrid oven 90 (see FIG. 9) in accordance with the present invention are illustrated. These materials, as well as others, may comprise components of an item to be cured and/or dried. As polyethylene is a material that may frequently be encountered in the MDF powdering process, the absorption spectrum for polyethylene 560 is illustrated, showing the wavelengths at which polyethylene preferentially absorbs infrared radiation. Infrared sources may be selected to preferentially interact with polyethylene (if the intention is to heat the polyethylene) or to avoid absorption by polyethylene (if the intention is to avoid heating the polyethylene). Infrared sources may be selected for use in an oven in accordance with the present invention based upon the rate at which radiation from those sources will, or will not, interact with typical powders or liquids.

Still referring to FIG. 6, an absorption spectrum for water 580 is also illustrated. As briefly described above, ovens in accordance with the present invention may frequently be employed to evaporate water from an MDF for curing and/or drying purposes. Accordingly, infrared sources used in an oven in accordance with the present invention may be preferentially selected from sources having a relatively high amount of emissions within the mid infrared range of the spectra highly absorbed by water molecules. Conversely, if the evaporation of water is not desired, sources that emit lesser amounts of radiation in a range of the spectrum preferentially absorbed by water molecules may be selected.

Still referring to FIG. 6, there are illustrated a few other examples of the emission spectra of infrared sources that may be used in an oven in accordance with the invention. The present invention may utilize various types of sources with similar or different emission spectra than depicted in the example of FIG. 6. For example, a halogen based near infrared (NIR) source may provide an emission spectrum similar to that depicted as 510. A short wave infrared source may provide an emission spectrum such as that depicted as 520, while a fast response medium wave infrared source may provide a spectrum such as depicted as 530. An exemplary carbon infrared source may provide an emission spectrum such as depicted as 540, while a medium wave source may provide a spectrum such as depicted as 550. A polyvinyl chloride (PVC) infrared source may provide an emission spectrum such as that depicted as 570. As illustrated in FIG. 6, each of these exemplary infrared sources produce an emission spectrum with a range of wavelengths, depicted along the x-axis, and a relative radiation power for a given source depicted along the y-axis. The radiative power depicted on the y-axis relates to the wavelength (or frequency) of the radiation in a known fashion.

As can be seen in FIG. 6, each of these example sources has a peak emitted wavelength outside of the visible region of electromagnetic radiation while emitting at a range of other wavelengths. However, infrared sources with narrower or broader emission spectra may be used in accordance with the present invention. Further, the effective relative power of different types of sources used in accordance with the present invention may be varied by using different wattages, different numbers of sources of a given type, different densities of sources, and different distances of sources from an item to be cured.

Figure 7:
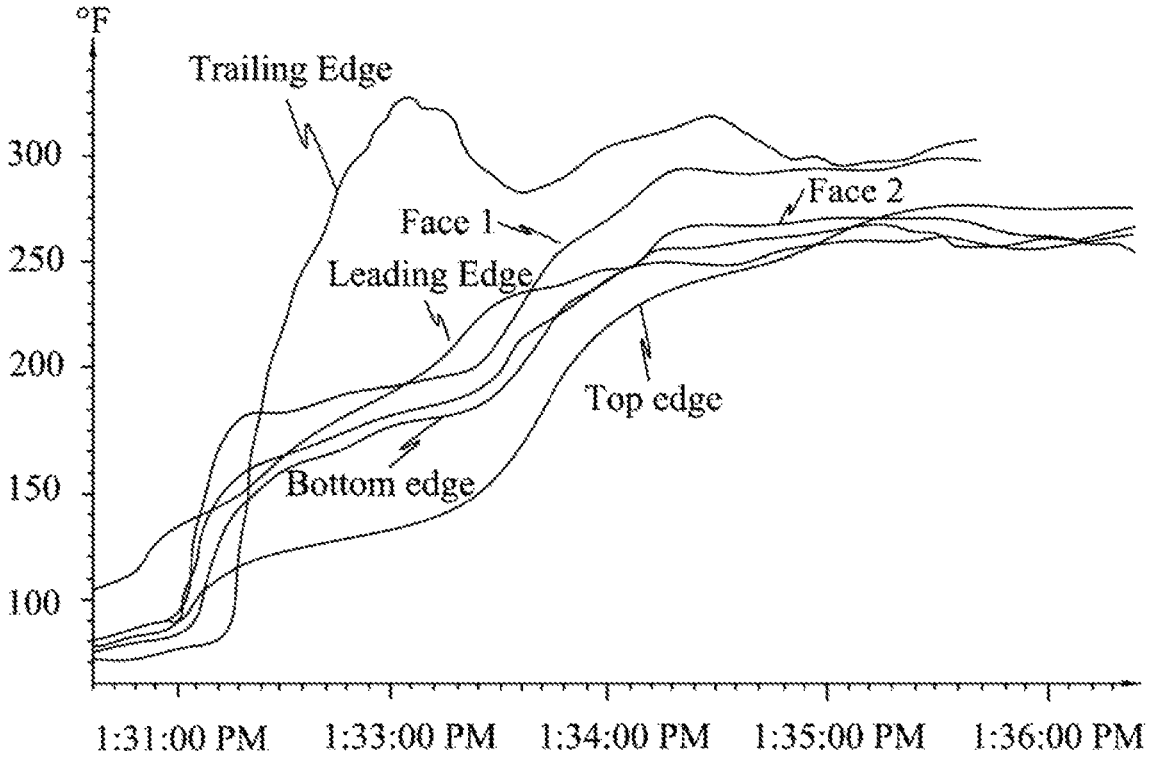
FIG. 7 illustrates a temperature profile of an MDF as it transits the edge sealing oven shown in FIG. 1.

Referring to FIG. 7, there is shown an illustration of a temperature profile of an MDF as it transits the edge sealing oven 10 shown in FIG. 1.

Figure 8:
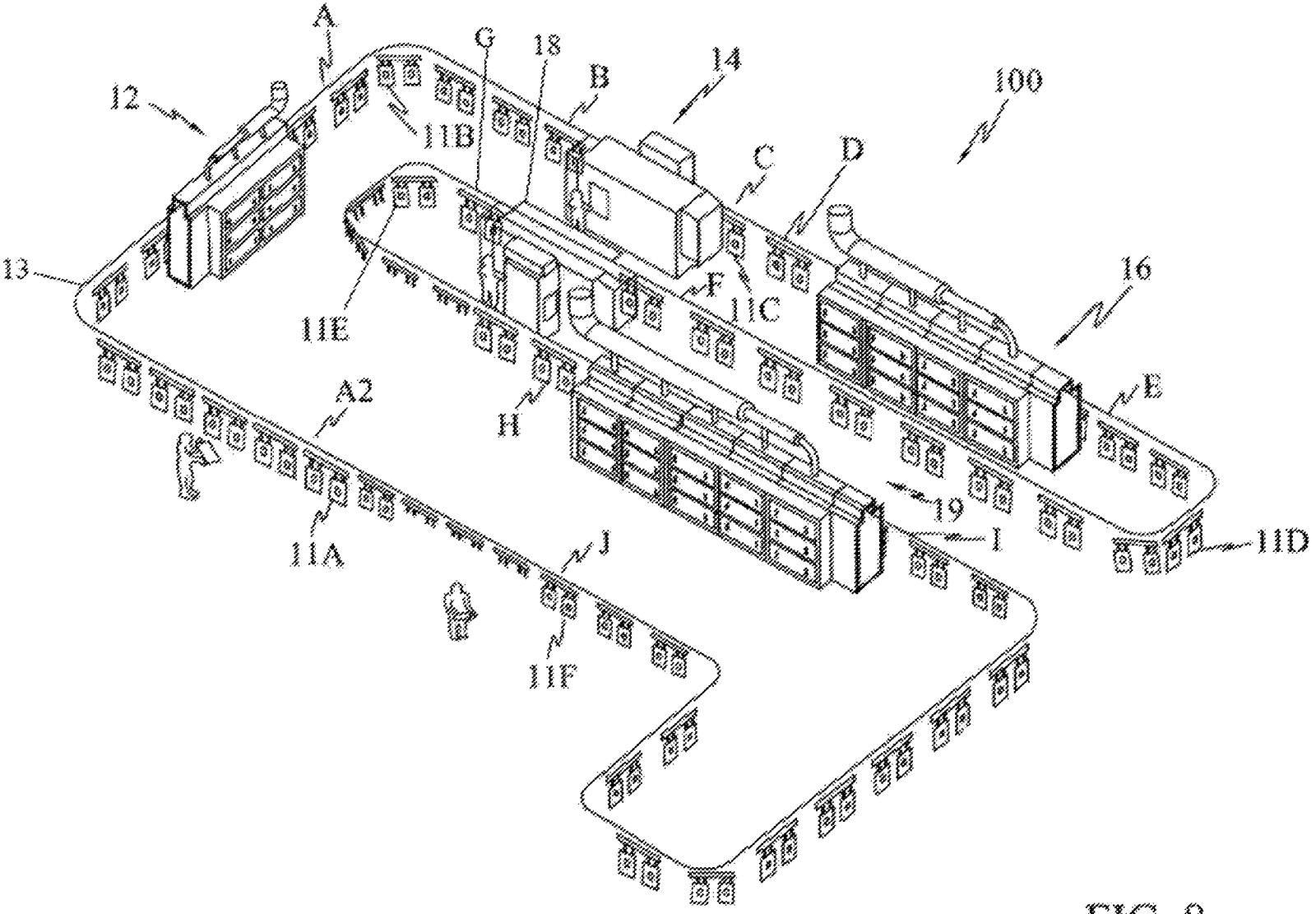
FIG. 8 is a diagram layout of an MDF powder coating production line in accordance with one embodiment of the present invention.

Referring also to FIG. 8, there is shown a diagram layout of a powder coating production line 100 for coating and curing EWP or MDF. The EWP or MDF are provided as boards 11A and are mounted on a continuously moving conveyor track 13 at a point A2. It will be appreciated that any suitable EWP may be used and that MDF and EWP are often used interchangeably. The board 11A is moved by the conveyor track 13 to a preheat oven 12. The preheat oven 12 heats the board 11A to approximately 200 degrees Fahrenheit in approximately 1.5 minutes. It will be appreciated that the conveyor track 13 can operate at any suitable line speed. For example, the conveyor track 13 can continuously operate at a speed of 6 feet per minute.

The preheated board 11B exiting the preheat oven 12 at a point A is at approximately 200 degrees Fahrenheit and thus conductive which allows powder to electrostatically adhere to the preheated board 11B. The conveyor track 13 moves the preheated board 11B from the point A to a point B in about 2 minutes where the preheated board 11B enters a primer booth 14 at approximately 100 degrees Fahrenheit.

The primer booth 14 electrostatically epoxy powder coats the face and edges of the preheated board 11B in approximately 1.5 minutes. Exiting the primer booth 14, the primed board 11C is conveyed by the conveyor track 13 from a point C to a point D in approximately 2 minutes where the primed board 11C enters a hybrid multi-section infrared gel oven 16. The infrared catalytic heater portion of the hybrid multi-section infrared gel oven 16 is described in U.S. Pat. No. 7,159,535 and incorporated herein by reference. In general, heat is produced when a gaseous fuel is brought into contact with a catalyst in the presence of air containing a normal level of oxygen. Typically, the fuels are natural gas, propane, and butane, for example.

Generally, the gaseous fuel is fed through a bottom of the catalytic heater and is dispersed at atmospheric pressure into contact with a porous active layer. This active layer contains a catalyst which may be platinum, for example. Oxygen from the atmosphere enters the porous catalytic layer and reacts with the gaseous fuel, promoted by the catalyst.

This reaction releases the BTU content in the fuel in the form of infrared heat. The chemical reaction that occurs during the oxidation reduction process produces temperatures within the catalyst of from about 500 to 1,000 degrees Fahrenheit (F). The by-products of the reaction include carbon dioxide and water vapor.

In approximately 3 minutes, the 3-section infrared gel oven 16 heats the primed board 11C to approximately 300 degrees Fahrenheit causing the epoxy powder on the primed board 11C to gel or partially liquefy.

Exiting the gel oven 16, the gelled board 11D is conveyed from a point E to a point F by the conveyor track 13 in approximately 8 minutes where the gelled board 11D enters a top coat booth 18 at approximately 130 degrees Fahrenheit. The top coat booth 18 top coats the gelled board 11D with another powder layer on all faces and edges of the gelled board 11D in approximately 1.5 minutes.

Figure 9:
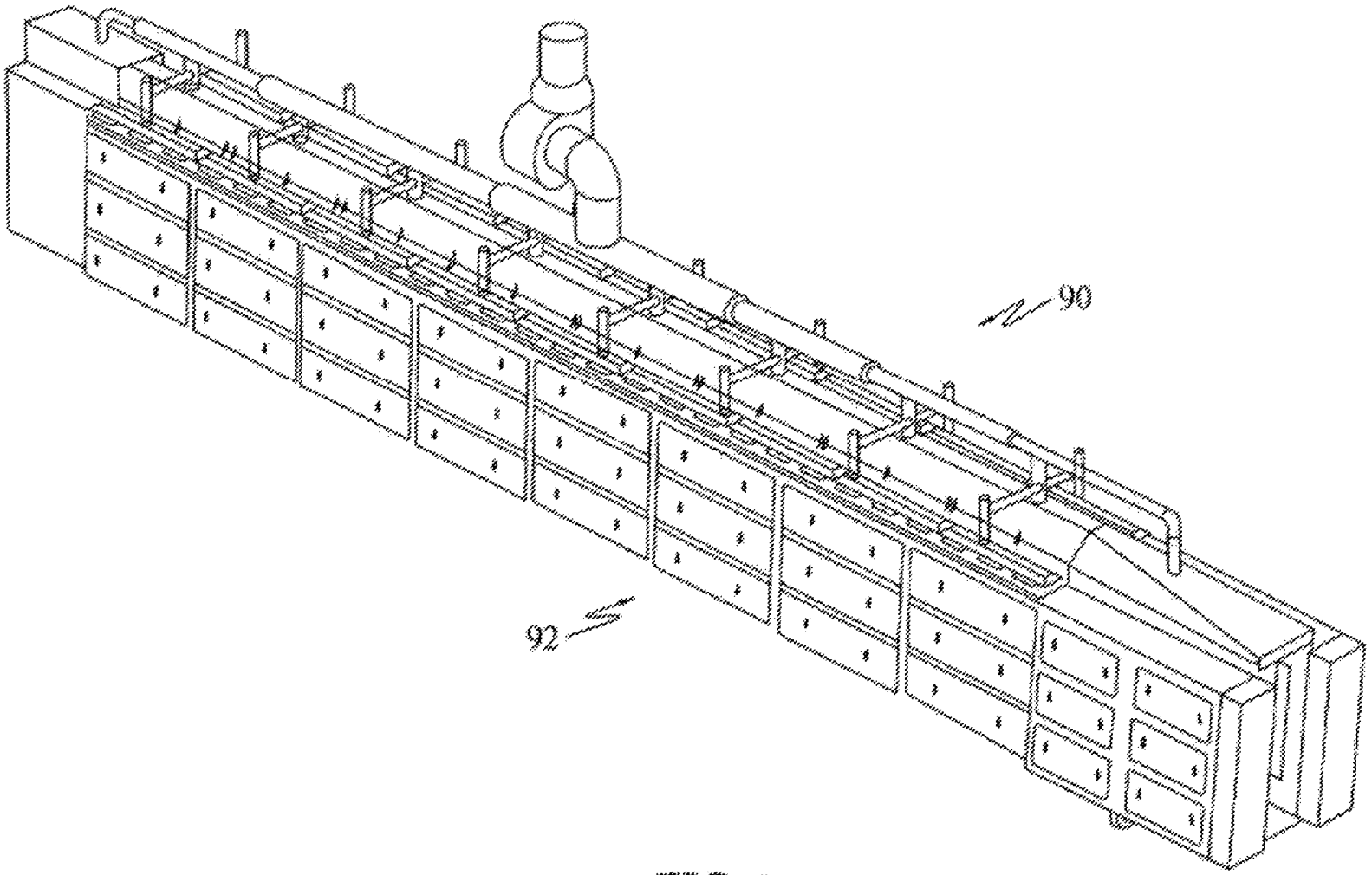
FIG. 9 is a pictorial view of a hybrid multi-section oven incorporating the edge sealing oven shown in FIG. 1.

Exiting the topcoat booth 18 at a point G, the top coated board 11E is conveyed to a point H where the top coated board 11E enters the multi-section hybrid cure oven 19 (see also the hybrid oven 90 depicted in FIG. 9). The multi-section hybrid cure oven 19 heats the top coated board 11E to approximately 300 degrees Fahrenheit in approximately 5.5 minutes which cures and hardens the previously applied primer coat and the previously applied top coat.

Exiting the multi-section hybrid cure oven 19 at a point I, the cured board 11F is conveyed to a point J in approximately 20 minutes allowing for the cured board 11F exiting the cure oven 19 at approximately 300 degrees Fahrenheit to air cool. At point J, the cooled and cured board 11F is removed from the conveyor track 13.

Referring to FIG. 9, there is shown a pictorial view of the hybrid multi-section oven 90 incorporating the edge sealing oven 10 shown in FIG. 1. It will be appreciated that the hybrid multi-section oven 90 may comprise any suitable number of edge sealing ovens 10 as described herein and any suitable number of curing ovens 92. It will be further appreciated that the infrared sources within the hybrid multi-section oven 90 may operate with different heating parameters. Heating parameters may comprise, but are not limited to, a peak spectral wavelength, an output power, a distance between one or more infrared sources and an item to be heated, a density of infrared sources within an area of an oven, a shape of infrared sources, an arrangement of infrared sources relative to an item to be heated, an air flow rate around an item to be heated, a relative humidity of air around an item to be heated, etc.

Different heating zones and/or different pluralities of infrared sources may share all, some, or no heating parameters. For example, different pluralities of infrared sources may operate at different peak spectra, and may have different spectral spreads (see FIG. 6). By way of further example, different pluralities of infrared sources may be spaced at different distances from an MDF board with greater numbers of sources per linear distance through the oven.

Yet further variation is possible by selecting or controlling the power output of individual infrared sources. For example, a first plurality of infrared sources may operate predominately in the mid infrared region, while a second plurality of infrared sources may operate in the near infrared portion of the spectrum. The plurality of mid infrared sources may be operated at a first wattage, while the plurality of near infrared sources may be operated at a second wattage. Similarly, the plurality of mid infrared sources may be positioned at a first distance from an MDF or EWP to be cured with a first linear distance between individual sources of the plurality of infrared sources of the mid infrared plurality, while the plurality of near infrared sources may be positioned at a second distance from an MDF or EWP to be cured with a second linear spacing.

Still referring to FIG. 9, the peak wavelength of one or more infrared sources used in the hybrid oven 90 in accordance with the present invention may be selected based upon the stage of a curing and/or drying process to be performed using a given source. Different stages of curing and/or drying may involve different edges or faces of the MDF or EWP to be cured and/or dried. For example, one or more mid infrared sources may be used at an early stage of an oven in order to quickly dry the MDF or EWP, as water molecules readily absorb mid infrared radiation, thereby evaporating, the water molecules.

Other types of materials, such as polyethylene, may preferentially absorb mid infrared radiation, thereby enabling such materials to be rapidly heated using mid infrared sources. Other types of materials may preferentially absorb other wavelengths, and infrared sources strongly emitting at those wavelengths may be selected to heat such materials. Based upon the heating to be performed, energy restrictions, time limitations, materials used, etc., different types of sources in different arrangements and numbers/densities may be used at various stages of an oven in accordance with the present invention.

In alternate embodiments, the board edges 33B, 33D may be pre-primed by a liquid primer. It will be understood that the liquid primer may be cured by any suitable method, such as heat curing (e.g., infrared absorption), for example, or by chemical reaction from catalyst curing and accelerators. It will also be understood that the liquid primer may be any suitable liquid primer such as PVA glue or other solvent based liquid such as, for example, a lacquer or enamel based primer. It will also be understood that the liquid primer may be a suitable water based primer.

Property characteristics of a suitable primer, water based or solvent based, include, but are not limited to, the capacity to be cured prior to any liquid induced deformation of the MDF or EWP; and, after curing, sufficient mechanical strength (which may be measured by hardness, toughness, stiffness and/or creep, or strength) to resist any deformation of the cured primer due to out-gassing or water vaporization discussed earlier.

Suitable primers, water or solvent based, may also include particulate matter such as resins, polymerized synthetics, or chemically modified natural resins including thermoplastic and/or thermosetting polymers. Suitable primers may also include amorphous solid particulate matter, such as, for example, glass or nanostructured materials, which may or may not exhibit glass-liquid transition.

It should be understood that the foregoing description is only illustrative of the invention. Thus, various alternatives and modifications can be devised by those skilled in the art without departing from the invention. For example, although the MDF or EWP are often flat, the same application technique applies to molded MDF or EWP components as in the case of molded plywood seats that are also stacked to expose the multiple layers of edges in a similar uniform fashion. Accordingly, the present invention is intended to embrace all such alternatives, modifications, and variances that fall within the scope of the appended claims. For example, any engineered wood product (EWP) having non-uniform densities may be edge coated as described herein.

Additionally, the section headings used herein are provided for consistency with the suggestions under 37 C.F.R. § 1.77 or to otherwise provide organizational cues. These headings shall not limit or characterize the invention set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention in this disclosure. Neither is the "Summary" to be considered as a limiting characterization of the invention set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the inventions, and their equivalents, that are protected thereby. In all instances, the scope of the claims shall be considered on their own merits in light of this disclosure, but should not be constrained by the headings set forth herein.

Finally, it will be understood that use of broader terms such as comprises, includes, and having should be understood to provide support for narrower terms such as consisting of consisting essentially of, and comprised substantially of. Use of the term "optionally," "may," "might," "possibly," and the like with respect to any element of an embodiment means that the element is not required, or alternatively, the element is required, both alternatives being within the scope of the embodiments. Also, references to examples are merely provided for illustrative purposes, and are not intended to be exclusive.

What is claimed is:

1. A method for electrostatic deposition and curing of a material on a product having a plurality of edges and faces, the method comprising:

providing a continuous conveyor track for sequentially delivering the product to a preheat oven, a primer booth, a gel oven, a top coat booth, and a cure oven;

preheating the product in the preheat oven with at least one preheat catalytic heater, wherein the preheat oven is adaptable to heat the product to approximately 200 degrees Fahrenheit, to create a preheated product;

priming the preheated product in the primer booth adaptable to coat the plurality of edges and faces of the preheated product conveyed from the preheat oven with the material, to create a primed preheated product;

heating the primed preheated product in the gel oven with a catalytic heater, wherein the gel oven is adaptable to heat the rimed preheated product conveyed from the primer booth to approximately 300 degrees Fahrenheit, to create a gelled product;

top coating the gelled product in the top coat booth adaptable to top coat the plurality of faces and edges of the gelled product conveyed from the gel oven with a top coat, to create a top coated product having top coated faces and edges; and curing the edges of the top coated product before curing the faces of the top coated product in the cure oven adaptable to heat the top coated product conveyed from the top coat booth to approximately 300 degrees Fahrenheit.

2. The method as in claim 1 wherein priming the preheated product further comprises electrostatically powder coating the plurality of faces and edges.

3. The method as in claim 1 wherein priming the preheated product further comprises liquid coating at least one of the plurality of faces and edges.

4. The method as in claim 1 wherein curing the edges of the top coated product comprises:

determining at least one infrared absorption characteristic of the material;

providing at least one edge sealing oven having at least one focused infrared (IR) emitter assembly for radiating IR energy onto the edges;

matching the IR energy to the at least one infrared absorption characteristic;

radiating from the at least one focused IR emitter assembly the matched IR energy; and reflecting the matched IR energy via a reflector onto the edges of the top coated product.

5. The method as in claim 4 further comprising selecting the reflector so that the matched IR energy that reaches the edges of the top coated product is substantially double the matched IR energy that reaches edges of the to coated product using another reflector.

6. The method as in claim 5 wherein the reflector is selected from the group consisting of a gold reflector and an opaque quartz glass reflector.

7. The method as in claim 4 wherein determining the at least one infrared absorption characteristic of the material further comprises determining the at least one infrared absorption characteristic of water.

8. The method as in claim 4 wherein determining the at least one preferential infrared absorption characteristic of the material further comprises determining the at least one preferential infrared absorption characteristic of polyethylene.

9. The method as in claim 4 wherein determining the at least one preferential infrared absorption characteristic of the material further comprises determining the at least one preferential infrared absorption characteristic of polyvinyl chloride molecule.

10. The method as in claim 4 wherein providing the at least one edge sealing oven having at least one focused infrared (IR) emitter assembly further comprises providing a transmission medium.

11. The method as in claim 10 wherein providing the transmission medium comprises providing a Fresnel lens transmission medium.

12. A method for curing a material on a product having a plurality of edges and faces;

providing a cure oven having at least one infrared edge sealing oven having at least one infrared emitter including at least one quartz lass component;

providing at least one infrared catalytic heater oven; and connecting the at least one infrared edge sealing oven and the at least one infrared catalytic heater oven with a continuous conveyor track; and curing the material in the cure oven so that the edges cure before the faces of the product.

13. The method as in claim 12 wherein providing a cure oven further comprises:

providing at least one infrared edge sealing oven, wherein providing the at least one infrared edge sealing oven comprises:

providing at least one focused infrared (IR) emitter assembly for radiating IR energy onto at least one of the plurality of edges, wherein the at least one focused infrared (IR) emitter assembly is selected from the group consisting of emitters adaptable to emitting a first radiation emission within a first infrared range of a spectra absorbed by a first molecule and emitters adaptable to emitting a second radiation emission within the first infrared range of the spectra absorbed by the first molecule; and providing at least one multiplying reflector for effectively multiplying the emitted IR energy radiated onto the at least one of the plurality of edges compared to the emitted IR energy radiated onto the at least one of the plurality of edges using another reflector.

14. The method as in claim 13 wherein providing the at least one focused infrared (IR) emitter assembly further comprises providing a first focusing transmission medium lens.

15. The method as in claim 14 wherein providing the first focusing transmission medium lens further comprises providing a Fresnel lens.

16. The method as in claim 14 wherein providing the first focusing transmission medium lens further comprises providing a quartz glass lens.

* * * * *